United States Patent [19]

Vaterlaus

[11] Patent Number: 4,765,390

[45] Date of Patent: Aug. 23, 1988

[54] METHOD OF AND ARRANGEMENT FOR COOLING A CONTINUOUSLY CAST STRAND

[75] Inventor: Arthur Vaterlaus, Rüschlikon, Switzerland

[73] Assignee: Concast Service Union AG, Zurich, Switzerland

[21] Appl. No.: 49,318

[22] Filed: May 12, 1987

[30] Foreign Application Priority Data

May 13, 1986 [CH] Switzerland ..... 01931/86

[51] Int. Cl.[4] ..... B22D 11/124

[52] U.S. Cl. ..... 164/486; 164/444

[58] Field of Search ..... 164/443, 444, 485, 486, 164/487

[56] References Cited

U.S. PATENT DOCUMENTS 3,468,361 9/1969 Fromson ..... 164/485

3,499,456 3/1970 Rerecich et al. ..... 164/485 X

FOREIGN PATENT DOCUMENTS 748910 9/1970 Belgium ..... 164/486

60-68147 4/1985 Japan ..... 164/486

*Primary Examiner*—Kuang Y. Lin

*Attorney, Agent, or Firm*—Peter K. Kontler; Tobias Lewenstein

[57] ABSTRACT

A continuous casting apparatus has a secondary cooling zone for spray cooling a travelling, continuously cast strand. Groups of spray nozzles are spaced longitudinally of the path of the strand on either side of such path. Each of the spray nozzles produces a flat, fan-shaped spray which diverges transversely of the path of the strand with increasing distance from the respective nozzle. The nozzles of a group are spaced from one another transversely of the path of the strand by a distance such that the sprays from two neighboring nozzles intermix to form a combined spray which, at the surface of the strand, has a length equal to the distance between the two nozzles. The portion of the strand extending between the outermost nozzles of each group is thus everywhere impinged by a combined spray. The marginal portions of the strand, on the other hand, are impinged only by the sprays from the respective outermost nozzles. The angles of divergence of the sprays are preferably in the range of 60 to 130 degrees.

13 Claims, 2 Drawing Sheets

METHOD OF AND ARRANGEMENT FOR COOLING A CONTINUOUSLY CAST STRAND

BACKGROUND OF THE INVENTION

The invention relates generally to continuous casting.

More particularly, the invention relates to a method of and an arrangement for cooling a continuously cast strand, e.g., a continuously cast steel slab.

In the continuous casting of slabs, particularly steel slabs, the slab is spray cooled in a secondary cooling zone after leaving the mold. To prevent crack formation on the slab surface, specific requirements are imposed on the spray cooling as regards uniformity, control of the spray intensity, adjustment to different slab widths, etc. Aside from these technical requirements, certain economic conditions such as low initial and maintenance costs, as well as low breakdown rates, must be satisfied.

The West German Offenlegungsschrift No. 2 401 263 discloses a cooling system for a secondary cooling zone which attempts to partially satisfy these complex requirements. In particular, controlled cooling is employed to avoid the formation of cracks on the slab surface. This cooling system is also intended to provide optimal results regardless of the shape and dimensions of the slab. The secondary cooling zone consists of a series of spaced support rolls on either side of the slab, and the cooling system consists of spray nozzles which spray cooling water onto the slab through the gaps between neighboring support rolls. A plurality of spray nozzles spaced transversely of the direction of travel of the slab is disposed in the region of each gap, and each nozzle is designed to direct a flat, fan-shaped spray towards the slab. The width of the sprays impinging upon the slab surface can be regulated by adjustable covers between the spray nozzles and the slab. The covers may have a sievelike, mesh-like or grate-like design in order to make these permeable to the cooling water.

Such adjustable covers require mechanically complex adjustment systems which must be remotely or manually repositioned when the slab width or the grade of steel is changed. Furthermore, the covers and their adjustment systems tend to require repairs or to be destroyed within a short period because of exposure to water vapor, thermal radiation and breakouts.

OBJECTS AND SUMMARY OF THE INVENTION

It is an object of the invention to provide a method which makes it possible to optimally adjust the spray cooling of continuously cast strands to different casting and strand parameters, e.g., casting speed, steel grade and strand width.

Another object of the invention is to provide a method which allows spray cooling of continuously cast strands to be controlled over a wide range.

A further object of the invention is to provide a spray cooling method which enables maintenance to be reduced.

An additional object of the invention is to provide a spray cooling method which may be performed without mechanically movable parts.

It is also an object of the invention to provide a spray cooling method which makes it possible to precisely regulate the output and distribution of the cooling fluid.

Still another object of the invention is to provide a spray cooling method which allows both optimum strand quality and optimum cooling of the continuous casting apparatus to be achieved.

A concomitant object of the invention is to provide an arrangement which makes it possible to optimally adjust the spray cooling of continuously cast strands to different casting and strand parameters, e.g., casting speed, steel grade and strand width.

Yet another object of the invention is to provide an arrangement which enables spray cooling of continuously cast strands to be regulated over a wide range.

An additional object of the invention is to provide a spray cooling arrangement which allows maintenance costs to be reduced.

Another object of the invention is to provide a spray cooling arrangement which does not require mechanically movable parts.

A further object of the invention is to provide a spray cooling arrangement which can be installed relatively inexpensively.

It is also an object of the invention to provide a spray cooling arrangement which makes it possible to regulate the output and distribution of the cooling spray with a high degree of precision.

Still another object of the invention is to provide a spray cooling arrangement which enables optimum strand quality, as well as optimum cooling of the continuous casting apparatus, to be achieved.

The preceding objects, and others which will become apparent as the description proceeds, are achieved by the invention.

One aspect of the invention resides in a method of cooling a continuously cast strand, e.g., a continuously cast steel slab. The method comprises the steps of conveying the strand along a predetermined path, and spraying the strand at a predetermined location of the path. The strand has a pair of lateral or marginal surface portions at such location which are spaced transversely of the path of the strand, and another or intermediate surface portion between the lateral surface portions. The spraying step includes directing a pair of flat sprays towards the intermediate surface portion from two positions spaced laterally of the path of the strand and disposed on either side of the intermediate surface portion, combining the pair of sprays to create a combined spray, and contacting the intermediate surface portion with the combined spray. The spraying step further includes contacting each of the lateral surface portions of the strand with a single flat spray only.

The strand may be guided between two series of spaced support rolls located on either side of the strand. In such an event, the sprays may be directed towards the strand through the gap between a pair of neighboring rolls.

Another aspect of the invention resides in a continuous casting apparatus, particularly for the continuous casting of steel slabs. The apparatus comprises means for conveying a continuously cast strand along a predetermined path, means for cooling the strand in the path. The cooling means includes a pair of spray nozzles each of which is designed to produce a flat spray having a spray angle between about 60 and about 130 degrees. The nozzles are disposed at a predetermined location of the path of the strand and are spaced from one another transversely of such path. The nozzles are arranged such that the respective sprays intersect each over a distance approximating the spacing between the nozzles.

The sprays may be fan-shaped, and each of the sprays then diverges transversely of the path of the strand with increasing distance from the respective spray nozzle. Depending upon the intensity of the sprays, which is also referred to as the specific density of the cooling fluid, an overall spray intensity corresponding to the specific requirements of the apparatus and/or the specific strand and casting parameters can be achieved by combining individual sprays.

Each of the sprays advantageously has a triangular intensity distribution, and the intersecting sprays are then preferably arranged so that these sprays intersect each other in the region between the respective nozzles over a distance equal to one-half the length of a spray. In order that the sprays may intersect one another over a distance equalling one-half the length of a spray, the corresponding nozzles should be spaced from each other by a distance equal to one-half the length of a spray. When the intersecting sprays have a triangular intensity distribution and the respective nozzles are separated by a distance equalling one-half the length of a spray, a resultant trapezoidal intensity distribution may be obtained. This may be achieved with two spray nozzles arranged side-by-side or with four spray nozzles arranged side-by-side. A triangular intensity distribution for the individual sprays thus allows a constant high spray intensity to be obtained in the central portion of the strand while the spray intensity at the two marginal portions of the strand decreases essentially continuously in a direction away from the central portion. The edges of the strand are thereby intentionally cooled less intensely than the central portion of the strand.

The spray intensity or specific quantity of cooling fluid can be regulated in dependence upon the strand and casting parameters by controlling the pressure of the cooling fluid.

Each of the spray nozzles may be provided with two or three outlet openings for the cooling fluid. A separate stream of cooling fluid issues from each outlet opening, and the streams from each nozzle cooperate to form the respective spray. Advantageously, the entire portion of the strand between neighboring nozzles is impinged by a combined spray resulting from the intersection or intermixing of the two sprays which emanate from the nozzles and are respectively composed of two or three streams of cooling fluid. On the other hand, each of the lateral or marginal portions of the strand, which are disposed to the outside of the region between the nozzles, is favorably impinged by a single spray made up of two or three streams of cooling fluid. The use of spray nozzles having two or three outlet openings allows the quantity of cooling fluid to be regulated within a wide range which is of particular advantage when the strand cross sections, steel grades, etc. vary greatly.

A nozzle having a plurality of outlet openings may be supplied with cooling fluid from two independent sources of such fluid.

Each nozzle may be provided with a pair of elongated or slot-like outlet openings which are spaced from and parallel to one another, and a third elongated or slot-like outlet opening located between and extending in parallelism with the first two openings. Here, one of the sources of cooling fluid may be connected to the central outlet opening while the other source is connected to the two lateral outlet openings. Advantageously, the fluid flow to the central outlet opening and the total fluid flow to the two lateral outlet openings are in a ratio of at least 1:2.

The novel features which are considered as characteristic of the invention are set forth in particular in the appended claims. The improved spray cooling arrangement itself, however, both as to its construction and its mode of operation, together with additional features and advantages thereof, will be best understood upon perusal of the following detailed description of certain specific embodiments when read in conjunction with the accompanying drawings.

DESCRIPTION OF THE PREFERRED EMBODIMENTS

Figure 1:
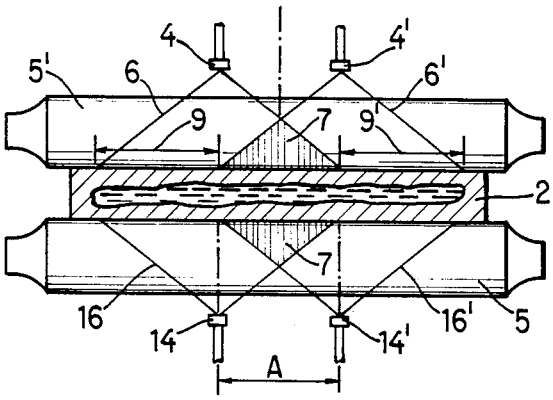
FIG. 1 is a schematic cross section through a secondary cooling zone of an apparatus for the continuous casting of slabs showing a slab in the process of being sprray cooled.

Referring to FIG. 1, the reference numeral 2 identifies a continuously cast strand in the form of a steel slab having a molten core 3. The slab 2 is conveyed along a predetermined path defined by a first series of rolls 5 which support the slab 2 from below and a second series of rolls 5' which confine the slab 2 from above. The rolls 5,5' constitute part of a means for conveying and guiding the slab 2 along the predetermined path which extends normal to the plane of the paper.

The rolls 5,5' form part of a secondary cooling zone of the continuous casting apparatus which produces the slab 2. In the secondary cooling zone, the upper and lower major surfaces of the slab 2 are spray cooled. To this end, first pairs of spray nozzles 14 and 14' are arranged below the path of the slab 2 at longitudinally spaced locations of the path while second pairs of spray nozzles 4 and 4' are disposed above the path of the slab 2 at longitudinally spaced locations of the path. Neighboring ones of the lower support rolls 5 are separated from one another by a gap longitudinally of the path of the slab 2 and each pair of lower spray nozzles 14,14' is located in the region of such a gap. Each lower spray nozzle 14 directs a flat, fan-shaped spray 16 towards the lower surface of the slab 2 through the adjacent gap and, similarly, each lower spray nozzle 14' directs a flat, fan-shaped spray 16' towards the lower surface of the slab 2 through the adjacent gap.

Neighboring ones of the upper support rolls 5' are likewise separated from one another by a gap longitudinally of the path of the slab 2 and each pair of upper spray nozzles 4,4' is again located in the region of such a gap. Each upper spray nozzle 4 directs a flat, fan-shaped spray 6 towards the upper surface of the slab 2 through the corresponding gap whereas each upper spray nozzle 4' directs a flat, fan-shaped spray 6' towards the upper surface of the slab 2 through the respective gap.

The spray nozzles 14,14' of each pair, as well as the nozzles 4,4' of each pair, are spaced from one another by a distance A as considered transversely of the path of the slab 2. The lower major surface of the slab 2 has a central portion which extends between the nozzles 14 and 14' and two lateral or marginal portions 9 and 9' respectively located on either side of the central portion. Similarly, the upper major surface of the slab 2 has a central portion which extends between the nozzles 4 and 4' and two lateral or marginal portions 9 and 9' respectively disposed on opposite sides of the central portion.

The individual sprays 16,16' issuing from each pair of lower spray nozzles 14,14' diverge transversely of the path of the slab 2 with increasing distance from the respective nozzles 14 and 14' and intersect or intermix with one another in the region between the corresponding nozzles 14 and 14' to form a combined spray 7. For ease of visualization, the combined spray 7 is hatched with vertical lines. The combined spray 7 from the lower nozzles 14,14' impinges upon the entire central portion of the lower surface of the slab 2, that is, the entire portion of the lower surface between the nozzles 14,14', but does not contact the marginal portions 9,9' of the lower surface which are located on opposite sides of the respective lower nozzle pair 14,14'. The lower marginal surface portion 9 is impinged only by the single spray 16 issuing from the lower nozzle 14 while the lower marginal surface portion 9' is impinged only by the single spray 16' issuing from the lower nozzle 14'.

In a similar manner, the individual sprays 6,6' generated by each pair of upper spray nozzles 4,4' diverge transversely of the path of the slab 2 with increasing distance from the respective nozzles 4 and 4' and intersect or intermix with one another in the region between the corresponding nozzles 4 and 4' to form a combined spray 7. The combined spray 7 from the upper nozzles 4,4' again contacts the entire central portion of the upper surface of the slab 2, namely, the portion of the upper surface traversing the nozzles 4,4', but does not impinge upon the marginal portions 9,9' of the upper surface which are disposed to either side of the respective upper nozzle pair 4,4'. The upper marginal surface portion 9 is impinged only by the single spray 6 issuing from the upper nozzle 4 whereas the upper marginal surface portion 9' is impinged only by the single spray 6' issuing from the upper nozzle 4'.

Each of the nozzles 4,4',14,14' may be provided with two or three outlet openings for the cooling fluid constituting the sprays 6,6',16,16'. A separate fan-shaped stream of cooling fluid then issues from each outlet opening and the streams from each nozzle 4,4',14,14' together make up the respective spray 6,6',16,16'. Depending upon whether a nozzle 4,4',14,14' has two or three outlet openings, the corresponding spray 6,6',16,16' is constituted by two or three fan-shaped streams of cooling fluid.

Figure 2:
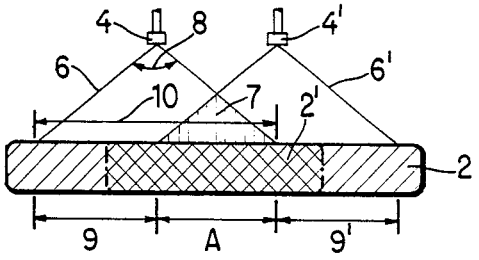
FIG. 2 illustrates the spray cooling of slabs of different width using two spray nozzles.

In FIG. 2, the same reference numerals as in FIG. 1 have been used to identify like features. For the sake of simplicity, only the upper spray nozzles 4,4' are shown in FIG. 2. However, the description of FIG. 2 also applies to the lower spray nozzles 14,14'.

The cross-hatched area in FIG. 2 identified by the reference numeral 2' represents a continuously cast slab having a width smaller than that of the slab 2. Thus, FIG. 2 shows that a pair of nozzles 4,4' spaced transversely of the path of the slab 2 by the distance A may be used to spray cool slabs of different width. As is conventional, the width of a slab is here the larger of the two dimensions of the slab as seen in a plane normal to the direction of advance of the slab.

The reference numeral 8 in FIG. 2 indicates the spray angle or angle of divergence of the sprays 6,6'. The spray angle 8, which is measured in a plane normal to the direction of advance of the slab 2, is preferably in the range of 60 to 130 degrees.

Figure 3:
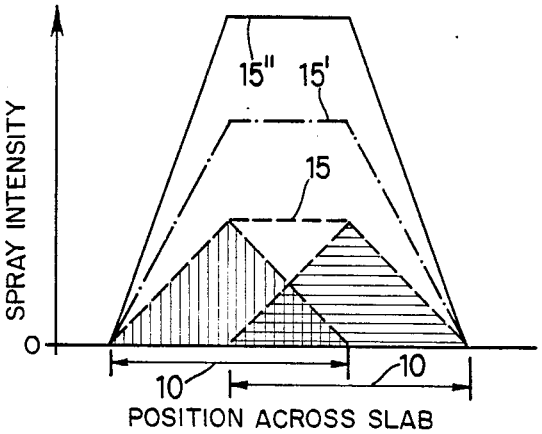
FIG. 3 is a schematic plot of spray intensity versus position across the slabs of FIG. 2.

FIG. 3, which is to be considered in conjunction with FIG. 2, is a schematic plot of the spray intensity on the upper surface of the slab 2 as a function of position across the slab 2. The spray intensity is plotted on the ordinate and increases from zero with increasing distance above the abscissa which represents position across the slab 2.

Each of the sprays 6,6' has a maximum length 10 as measured at the upper surface of the slab 2 in a direction along the width of the latter. The lengths 10, as well as the spray angles 8, of the two sprays 6,6' are here shown as being equal. The nozzles 4,4' are arranged such that the maximum length of the combined spray 7 as measured at the upper surface of the slab 2, that is, the distance across the slab 2 over which the sprays 6,6' intersect, equals one-half of the length 10. Stated differently, one-half of the length 10 of the spray 6 and one-half of the length 10 of the spray 6' overlap in the region between the nozzles 4,4'. This is best seen in FIG. 3.

FIG. 3 further shows that the two sprays 6,6' have identical triangular distributions of spray intensity. For ease of visualization, the intensity distribution of the spray 6 is hatched with vertical lines and the intensity distribution of the spray 6' is hatched with horizontal lines. The cross-hatched area corresponds to the combined spray 7. When the nozzles 4,4' are arranged such that one-half of the lengths 10 of the respective sprays 6,6' overlap in the region between the nozzles 4,4', summation of the individual triangular intensity distributions of the sprays 6,6' yields a resultant trapezoidal spray intensity distribution as indicated by the broken line 15. This means that the spray intensity is constant across the central portion of the slab 2 which extends between the nozzles 4,4' and decreases continuously at the marginal portions 9,9' with increasing distance from the central portion.

The spray intensity may be defined as the quantity of cooling fluid sprayed onto the slab 2. Depending upon the design of the nozzles 4,4', the spray intensity of each spray 6,6' over the respective length 10 can be adjusted within certain limits.

Figure 4:
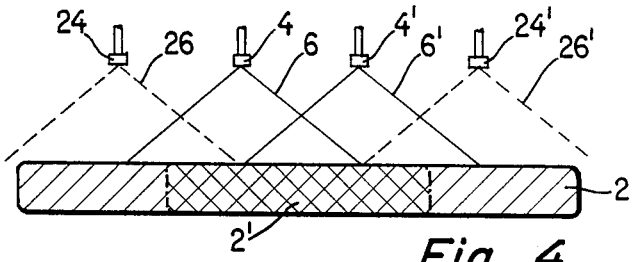
FIG. 4 illustrates the spray cooling of slabs of different width using four spray nozzles.

In FIG. 4, the same reference numerals as in FIGS. 1 and 2 are used to denote like features.

FIG. 4 illustrates spray cooling of the slab 2 using four nozzles 4,4',24,24'. The nozzles 24,24' are similar to the nozzles 4,4' and generate respective flat, fan-shaped sprays 26,26' having triangular intensity distributions and diverging in a direction away from the corresponding nozzles 24,24'.

The nozzles 4,4',24,24' are arranged in a horizontal line extending normal to the direction of advance of the slab 2 and are spaced from one another transversely of the path of the slab 2 by the distance A. The nozzle 4 is located between the nozzles 4' and 24 and the spray 6 from the nozzle 4 intersects the spray 6' from the nozzle 4' as before. In addition, the spray 6 intersects the spray 26 from the nozzle 24 in the region between the nozzles 4,24 to form a combined spray which impinges upon the portion of the slab 2 intermediate the nozzles 4,24. Similarly, the nozzle 4' is disposed between the nozzles 4 and 24' and the spray 6', aside from intersecting the spray 6, also intersects the spray 26' from the nozzle 24' in the region between the nozzles 4',24' to form a combined spray which contacts the portion of the slab 2 intermediate the nozzles 4',24'. It will be observed that the spray 6 is intersected by the spray 6' over one-half of its length and by the spray 26 over the other half of its length. In like manner, the spray 6' is intersected by the spray 6 over one-half of its length and by the spray 26' over the other half of its length. Accordingly, each of the sprays 6,6' is intersected by neighboring sprays over its entire length. On the other hand, each of the sprays 26, 26' is intersected by a neighboring spray over one-half of its length only.

The nozzles 24,24' are located near the marginal portions of the slab 2 and those halves of the corresponding sprays 26,26' which are not intersected by neighboring sprays impinge upon such marginal portions. Thus, the marginal portions of the slab 2 are again contacted by a single spray 26 or 26' only.

As in FIG. 2, the cross-hatched area in FIG. 4 identified by the reference numeral 2' represents a slab having a width smaller than that of the slab 2. When the slab 2' is being cast, the nozzles 24,24' are shut off and only the nozzles 4,4' are in operation. It will be observed that the central portion of the slab 2' located between the nozzles 4,4' is then contacted by a combined spray resulting from the intermixing of the sprays 6,6' while the marginal portions of the slab 2' are impinged by a single spray 6 or 6' only.

Figure 5:
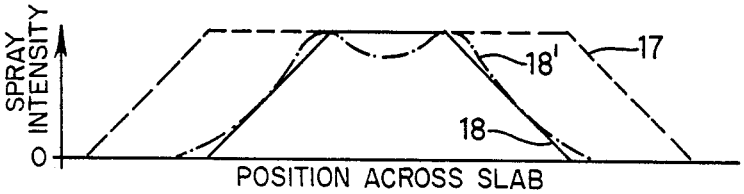
FIG. 5 is a schematic plot of spray intensity versus position across the slabs of FIG. 4.

FIG. 5 is a plot of spray intensity versus position across the slab 2 or 2' and is similar to FIG. 3. In FIG. 5, the trapezoid drawn in full lines and identified by the reference numeral 18 represents the resultant spray intensity of the sprays 6,6', that is, the sum of the spray intensities of the two sprays 6,6'. On the other hand, the trapezoid shown in broken lines and identified by the reference numeral 17 represents the resultant spray intensity of all four sprays 6,6',26,26'.

Trapezoids such as 17 and 18 represent idealized resultant spray intensities of groups of spray nozzles. In reality, as indicated by measurements of spray intensity, the resultant spray intensity of a group of spray nozzles is not defined by straight lines but, rather, by an undulating line. The dash-and-dot line 18' in FIG. 5 shows the resultant spray intensity of the spray nozzles 6,6' at it would appear based on measurements of spray intensity.

In an apparatus for the continuous casting of strands having different widths, it is of advantage to employ an invariant arrangement of spray nozzles in which the distance A between neighboring nozzles is fixed and satisfies the following relationships:

$$A = B_{min} \quad (1)$$

$$3A = B_{max} \quad (2)$$

where $B_{min}$ represents the minimum possible strand width and $B_{max}$ represents the maximum possible strand width.

Figure 6:
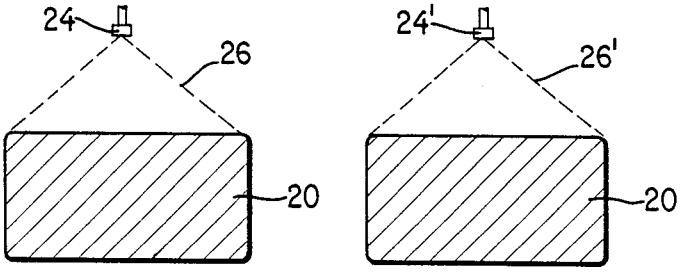
FIG. 6 illustrates the spray cooling of two blooms using the spray nozzles of FIG. 4.

As illustrated in FIG. 6, a continuous casting apparatus such as that of FIG. 4 may be convertible so as to simultaneously cast a pair of blooms 20 and 20' rather than a single slab 2 or 2'. Only the nozzles 24 and 24' are then in operation.

Figure 7:
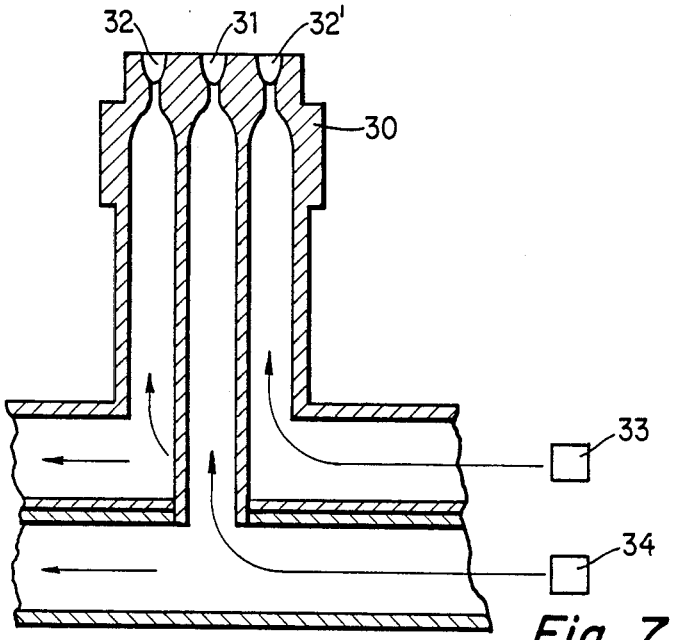
FIG. 7 is a sectional view of a spray nozzle having several outlet openings for cooling fluid.
Figure 8:
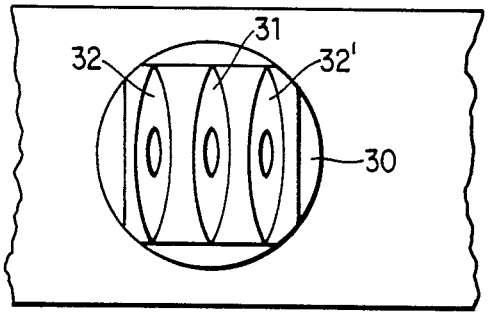
FIG. 8 is a plan view of the spray nozzle of FIG. 7.

FIGS. 7 and 8 show a spray nozzle 30 having two spaced spray or outlet openings 32 and 32', and a third spray or outlet opening 31 disposed between the outlet openings 32,32'. The outlet openings 31,32,32' have elongated or slot-like configurations and are parallel to one another. The nozzle 30 is connected to two independent sources 33 and 34 of cooling fluid. The source 34 communicates with the central outlet opening 31 while the source 33 communicates with the two lateral outlet openings 32,32'. When a low cooling intensity is required, it is sufficient to spray the strand via the central outlet opening 31 only. If an increased cooling intensity is desired, e.g., a doubled cooling intensity, the source 34 is shut off while the source 33, which supplies cooling fluid to the two outlet openings 32,32', is turned on. A further increase in cooling intensity may be obtained by having both sources 33,34 operate simultaneously so that cooling fluid issues through all three outlet openings 31,32,32'.

Each of the outlet openings 31,32,32' is designed to produce a flat, fan-shaped stream of finely dispersed cooling fluid having a triangular intensity distribution. The outlet openings 31,32,32' are arranged in the common nozzle 30 in such a manner that the individual streams merge with one another at a distance of several centimeters from the outlet openings 31,32,32' due to a mutual suction effect to form a flat, fan-shaped spray. The spacing between neighboring outlet openings 31,32,32' is generally 10 to 20 millimeters and, at most, 30 to 40 millimeters.

Each of the cooling fluid sources 33,34 is equipped with its own pressure regulating means so that the spray intensity of the nozzle 30 can be varied essentially steplessly between a minimum and a maximum value.

When two of the nozzles 30 are mounted in the manner of the nozzles 4,4' of FIG. 2, a range of resultant spray intensities may be readily achieved. These resultant intensity distributions are again substantially trapezoidal. With reference once more to FIG. 3, when only the central outlet openings 31 of the nozzles 30 are employed, the resultant intensity distribution might, for instance, correspond to the trapezoidal distribution 15. On the other hand, the resultant intensity distribution of the two nozzles 30 might be represented by the trapezoidal distribution 15' shown in dash-and-dot lines when the two outlet openings 32,32' of each nozzle 30 are in operation, and by the trapezoidal distribution 15'' drawn in full lines when all three outlet openings 31,32,32' of the nozzles 30 are used.

The quantity of cooling fluid supplied to the central outlet opening 31 of a spray nozzle 30 and that supplied to the two lateral outlet openings 32,32' are preferably in a ratio of at least 1:2, particularly when the cooling fluid flowing to the outlet opening 31 is under the same pressure as the cooling fluid flowing to the outlet openings 32,32'.

The cooling fluid will normally comprise water and the sprays may be produced by means of nozzles designed to operate with water alone or with an air-water mixture.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of cooling a continuously cast strand, comprising the steps of conveying said strand along a predetermined path; and spraying said strand at a predetermined location of said path, said strand having a pair of lateral surface portions at said location which are spaced transversely of said path, and another surface portion between said lateral surface portions, and the spraying step including directing a pair of flat sprays towards said another surface portion from two positions spaced laterally of said path and disposed on either side of said another surface portion, combining said pair of sprays to create a combined spray, and contacting said another surface portion with said combined spray, each of said pair of sprays having a triangular intensity distribution, and a predetermined length as considered transversely of said path, and said combining being performed by causing each of said pair of sprays to intersect the other over a distance approximating one-half of said predetermined length, the spraying step further including contacting each of said lateral surface portions with a single flat spray only.

2. The method of claim 1, wherein said 2 pair of sprays together have an approximately trapezoidal intensity distribution.

3. The method of claim 1, wherein said positions are spaced by a distance A such that A approximately equals $B_{min}$ and 3A approximately equals $B_{max}$ where $B_{min}$ is the minimum possible width of said strand and $B_{max}$ is the maximum possible width of said strand.

4. The method of claim 1, wherein each of said flat sprays is constituted by two or three fluid streams issuing from separate apertures.

5. The method of claim 1, wherein said strand is a steel slab.

6. A method of cooling a continuously cast strand, comprising the steps of conveying said strand along a predetermined path; and spraying said strand at a predetermined location of said path, said strand having a pair of lateral surface portions at said location which are spaced transversely of said path, and another surface portion between said lateral surface portions, and the spraying step including directing a pair of flat sprays towards said another surface portion from two positions spaced laterally of said path and disposed on either side of said another surface portion, combining said pair of sprays to create a combined spray, and contacting said another surface portion with said combined spray, said pair of sprays together having an approximately trapezoidal intensity distribution, and the spraying step further including contacting each of said lateral surface portions with a single flat spray only.

7. A continuous casting apparatus, particularly for the continuous casting of steel slabs, comprising means for conveying a continuously cast strand along a predetermined path; and means for cooling the strand in said path, said cooling means including a pair of spray nozzles each of which is designed to produce a flat spray having a triangular intensity distribution, a predetermined length as considered transversely of said path and a spray angle between about 60 and about 130 degrees, and said nozzles being disposed at a predetermined location of said path and being spaced from one another transversely of said path by approximately one-half of said predetermined length, said nozzles being arranged such that the respective sprays intersect each other over a distance approximating the spacing between said nozzles.

8. The apparatus of claim 7, wherein said nozzles are spaced by a distance A such that A approximately equals $B_{min}$ and 3A approximately equals $B_{max}$ where $B_{min}$ is the minimum possible width of said path and $B_{max}$ is the maximum possible width of said path.

9. The apparatus of claim 7, comprising a pair of independent fluid sources, at least one of said nozzles being connected to both of said sources.

10. The apparatus of claim 9, said one nozzle having a pair of elongated, substantially parallel first spray openings, and an elongated second spray opening located between and extending substantially parallel to said first spray openings; and wherein one of said sources communicates with said first spray openings and the other of said sources communicates with said second spray opening.

11. The apparatus of claim 10, said sources generating approximately equal pressures; and wherein the fluid flow to said second spray opening and the total fluid flow to said first spray openings are in a ratio of at least 1:2.

12. The apparatus of claim 7, wherein said nozzles are designed so that the pair of sprays therefrom together have an approximately trapezoidal intensity distribution.

13. A continuous casting apparatus, particularly for the continuous casting of steel slabs, comprising means for conveying a continuously cast strand along a predetermined path; and means for cooling the strand in said path, said cooling means including a pair of spray nozzles each of which is designed to produce a flat spray having a spray angle between about 60 and about 130 degrees, and said nozzles being disposed at a predetermined location of said path and being spaced from one another transversely of said path, said nozzles being arranged such that the respective sprays intersect each other over a distance approximating the spacing between said nozzles, and said nozzles being designed so that the pair of sprays therefrom together have an approximately trapezoidal intensity distribution.

* * * * *